United States Patent [19]

De Gryse

[11] 4,178,845

[45] Dec. 18, 1979

[54] TWISTING AND CUTTING DEVICE FOR BINDING AT LEAST ONE THREAD PUT AROUND A PRESSED BALE

[75] Inventor: Jean-Claude De Gryse, Dadizele, Belgium

[73] Assignee: Naamloze Vennootschap Declametaal, Dadizele, Belgium

[21] Appl. No.: 887,804

[22] Filed: Mar. 17, 1978

[30] Foreign Application Priority Data

Mar. 23, 1977 [BE] Belgium ..... 852797

[51] Int. Cl.[2] ..... B65B 13/28

[52] U.S. Cl. ..... 100/11; 100/31

[58] Field of Search ..... 100/11, 31; 140/93 A, 140/93.6, 115, 119

[56] References Cited

U.S. PATENT DOCUMENTS

| | | | |
|---|---|---|---|
| 646,819 | 4/1900 | Foster | 100/31 |
| 1,004,555 | 10/1911 | Brooks | 100/31 X |
| 1,120,346 | 12/1914 | Tibbe | 100/11 |
| 1,595,845 | 8/1926 | Wood | 100/11 |
| 1,757,817 | 5/1930 | Simpson | 100/11 |
| 2,585,425 | 2/1952 | Baskerville | 100/11 X |

*Primary Examiner*—Billy J. Wilhite

*Attorney, Agent, or Firm*—Stevens, Davis, Miller & Mosher

[57] ABSTRACT

The device comprises a frame, a twisting member rotatably mounted in relation to the frame to carry along and twist two parts of thread, means for driving the twisting member, and a knife. The twisting member consists of a gear-wheel and the means for driving also comprise a gear-wheel which is in gear with the twisting member. The valleys between the teeth of the twisting member are cut deeper than is required to be in gear with the gear-wheel of the driving means.

8 Claims, 4 Drawing Figures

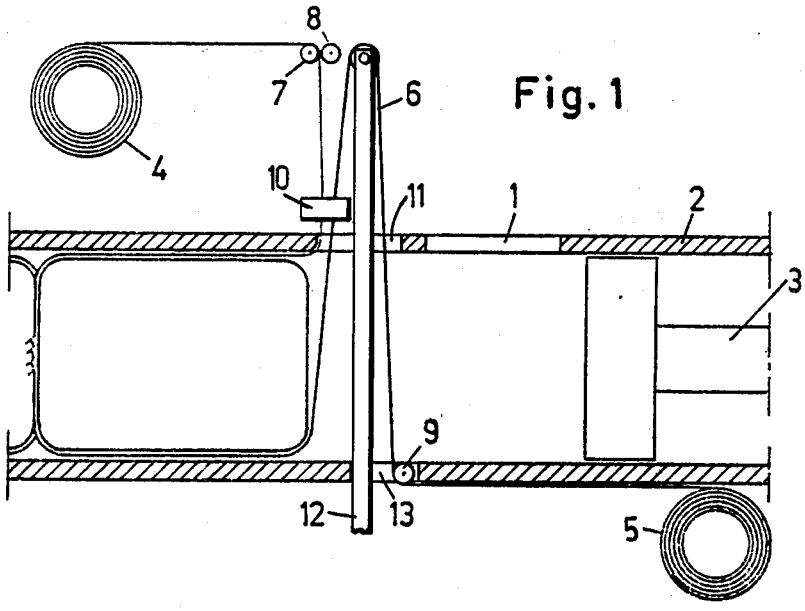
Fig. 1
Fig. 3
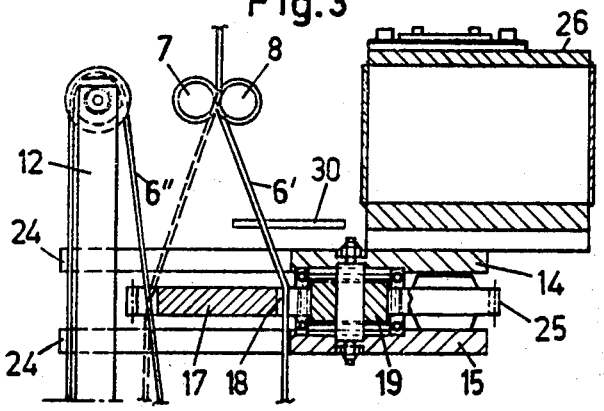
Fig. 4
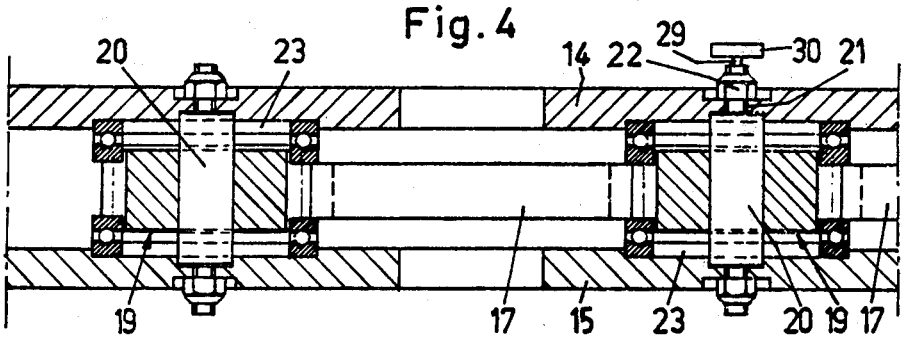

TWISTING AND CUTTING DEVICE FOR BINDING AT LEAST ONE THREAD PUT AROUND A PRESSED BALE

BACKGROUND

The invention relates to a twisting and cutting device for binding at least one thread that is put around a pressed bale, the said thread comprising two parts twisted together, which each are running from a feeding spool and are made to be adjacent to each other at the location of the twisting and cutting device, the said device comprising a frame, at least one twisting member rotatably mounted in relation to this frame for carrying along and twisting the parts of the thread which have been made to be adjacent to each other, means for driving the said twisting member, and at least one knife mounted in relation to the frame for cutting through the thread parts after twisting.

Such twisting and cutting devices are used on bale binding appliances, on which at least one thread which comes from a feeding spool and is assembled by twisting with a second thread which comes from a second feeding spool is carried in front of the material that is to be pressed. The two said threads are then forming two parts of a new thread that is running between the two feeding spools, which thread is pushed away when the bale is being pressed so as to partly surround the bale. One of the parts of the last mentioned thread is being drawn or pushed by means of either a hook or spear just behind the pressed bale till it is adjacent to the first mentioned part so as to completely encircle the bale. Then, by means of the twisting and cutting device, these two parts are being twisted together, after which the twisted part is being cut through so that the two thread parts coming from the two feeding spools and as well the two thread parts encircling the pressed bale are twisted together at their ends.

In a known twisting and cutting device of this kind, the twisting member is formed by a disc provided with two curved fingers of unequal length. Whilst the said disc rotates, one of the fingers takes along the one part and the other finger takes along the other part of the thread parts to be twisted. This disc is rotatably mounted in relation to the frame via a part of the driving mechanism of the disc itself, this driving mechanism being of a complicated construction.

Several threads, often four threads, are normally used for one bale. The total twisting and cutting device comprises one twisting disc per thread, each twisting disc containing a rather complicated driving mechanism.

An object of the invention is to provide a twisting and cutting device that is of a very simple design, and mainly so if the twisting and cutting device is used for simultaneously twisting and cutting a multiplicity of threads.

THE INVENTION

In order to achieve this, the twisting member consists exclusively of a gear-wheel and the means for driving the twisting member also comprise a gear-wheel the teeth of which are in gear with the twisting member, the valleys between at least two pairs of teeth of the twisting member are cut deeper than is normally required for being in gear with the gear-wheel of the driving means, this in such a way that one of the thread parts to be twisted can be carried along by the twisting member without interference of the last mentioned gear-wheel, and finally the frame is provided in front of the twisting member with a cut out aperture facing the parts to be twisted and permitting these parts to enter into the deepened valleys of the twisting member and to be taken along when the twisting member rotates, without interference of the frame.

In a particular embodiment of the invention, all valleys between all teeth of the gear-wheel forming the twisting member are cut out deeper than is necessary for cooperating with the gear-wheel of the means for driving the twisting member.

In an advantageous embodiment of the invention, the twisting member is rotatably mounted in relation to the frame through the intervention of three gear-wheels, which are rotatably mounted in relation to the frame, one at least of same being the aforesaid gear-wheel of the means for driving the twisting member.

In a preferably applied embodiment of the invention, the device comprises at least two twisting members, which are mounted side by side and are for twisting together parts of different threads, each of the said twisting members being formed by a gear-wheel having a deepened valley between at least two pairs of teeth.

The means for driving the twisting members preferably comprise means for driving one of these members and at least one gear-wheel transmission between the adjacent twisting members and, consequently, also between the aforesaid directly driven twisting member and an adjacent twisting member.

THE DRAWINGS

FIG. 1 is a schematic side view of a device for binding bales wherein the twisting and cutting device according to the invention is mounted.

FIG. 3 is a section along the line III—III of FIG. 2, but with parts of the device for binding bales in which the twisting and cutting device according to the invention is mounted.

FIG. 4 is a section along the line IV—IV of FIG. 2, but drawn to a greater scale.

In the various figures, the same reference numbers relate to the same components.

DESCRIPTION OF THE PREFERRED EMBODIMENT

Figure 2:
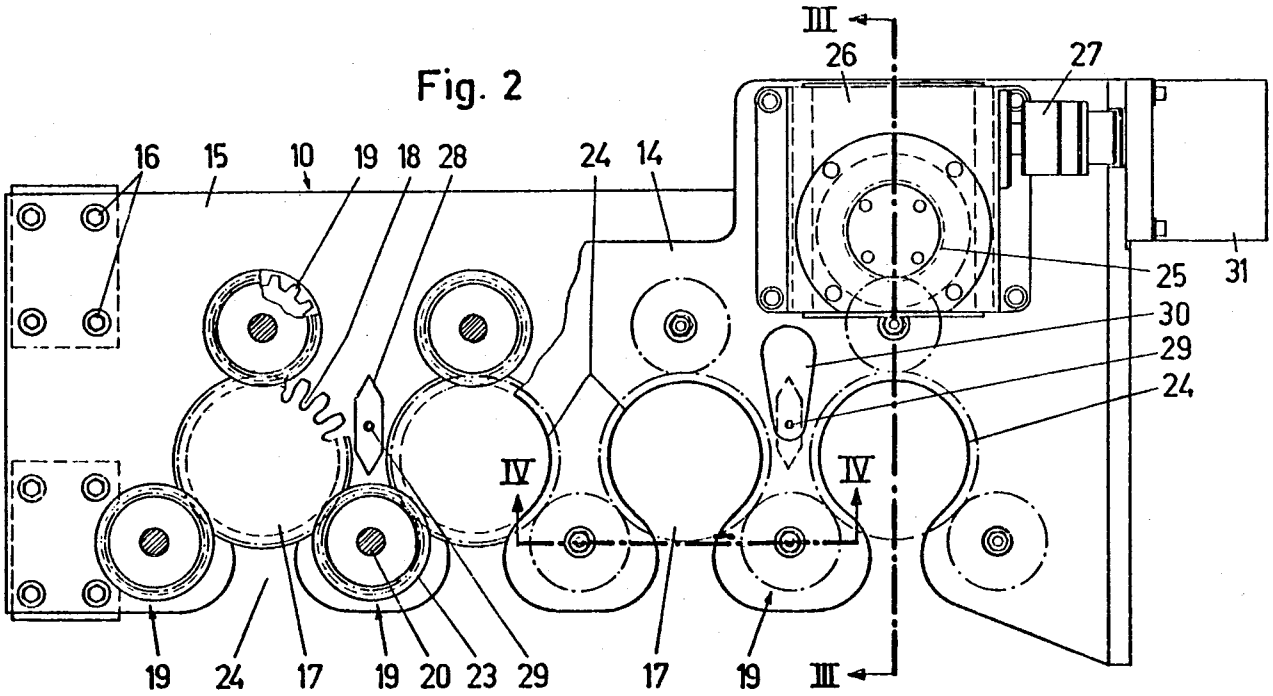
FIG. 2 is a bird's-eye view, with part section, of a twisting and cutting device according to the invention.

For pressing bales, the material to be pressed, for instance paper, is inserted through a filling aperture 1 into a trunk 2, which is open at both ends, in which moves a piston 3. Pairs of feeding rolls 4 and 5 are mounted for binding the bales. The feeding rolls 4 are located on one side and at one end of the trunk, whilst the feeding rolls 5 are mounted at the other side of the trunk. The ends of the thread parts on the feeding rolls 4 are twisted at the ends of the thread parts on the feeding rolls 5. In this way there is obtained a number of threads running between the rolls 4 and 5, which are lead by means of the little wheels 7 and 8, and 9, and through apertures in the trunk, in such a way that, before the pressing of the bale, they pass across the trunk. Such a thread 6 runs, as shown in FIG. 1, from the feeding roll 4 between the little wheels 7 and 8, then via a twisting and cutting device which as a whole is indicated by the reference number 10 and through an aperture 11 at one side of the trunk in the trunk and finally over a little wheel 9 mounted at the other side of the trunk in an aperture 13, outside the trunk, and farther in longitudinal direction to the feeding roll 5. When the piston 3 presses the material, the threads 6 that cross the trunk are carried along by the material until the threads encircle the pressed bale at top side, bottom side and front side. The parts of thread 6 located behind the pressed bale are carried along, in the vicinity of the little wheels 9, by movable spears 12 entering the trunk through the apertures 13 and afterwards coming out of the said trunk through the said aperture 11. These spears carry along a part of the thread along the rear of the bale and also through the twisting and cutting device. Both ends of the part of the threads 6 which now fully encircle the pressed bale are thus inserted in the twisting and cutting device 10 which is now made to operate, whereby these ends are twisted together. On both sides of the twisting device an effective twisted is obtained. Between the two twists, the parts twisted together of the threads 6 are then cut through by the device 10. In this way, the part of the threads 6 encircling the pressed bale, the ends of which are twisted together, is separated from the remainder of the threads 6. The ends of the parts running towards the feeding rolls 4 and 5, which are the remainder of the threads 6, are also attached the one to the other so that, when the spears 12 have taken their initial position again, the initial arrangement is obtained again and it is possible to press a following bale in the same way.

The twisting and cutting device 10 according to the FIGS. 2 thru 4 comprises a frame consisting of a substantially rectangular upper plate 14 and a substantially rectangular lower plate 15 fixed by means of bolts 16 on the frame of the herein above described pressing and binding device.

Between the two plates 14 and 15, a twisting member 17, say one per thread that is to be slung around the bale, is mounted. In this case, four suchlike twisting members 17 are located between the plates 14 and 15. Each twisting member is in fact a gear-wheel, the valleys of which between all teeth are cut out deeper than is necessary. The deepened part shaped in this way is referred to in FIG. 2 by the reference number 18.

The four twisting members 17 have no shaft at all, but are rotatably mounted in relation to the plates 14 and 15 by the fact that they are imprisoned between three planet wheels 19 located at the three angles of an equilateral triangle. A planet wheel 19 of each trio surrounding a twisting member 17 is at the same time a part of the trio holding the adjacent twisting member 17. Consequently, only nine planet wheels 19 are required to hold the four twisting members 17. Each planet wheel 19 is rotatably mounted on a stationary shaft 20, the ends of which have a smaller diameter and pass through holes 21 in the plates 14 and 15. On the smaller ends extending past the plates 14 and 15, a nut 22 is screwed, so that the shafts 20 of all planet wheels 19, maintain the plates 14 and 15 fixed at a constant distance the one in relation to the other. Between each planet wheel 19 and respectively the upper plate 14 and the lower plate 15 there is mounted a round ball bearing 23 which may or may not form a whole with the planet wheel. The outside diameter of this round ball bearing 23 is greater than the outside diameter of the wheels. Thus, the two ball bearings 23 which are mounted on both sides of one and the same planet wheel form shoulders between which a twisting member 17 is maintained, in such a way that the twisting member 17 remains at a same distance from plates 14 and 15.

The planet wheels 19 are also gear-wheels the teeth of which are in gear with the twisting members 17. The deeper parts 18 are not interfering with the transmission. These deeper parts 18 are large enough to house one of the parts to be twisted of a thread 6 and to carry this part along, through rotation of the twisting member 17, without hindrance from the planet wheels 19.

The reason why the twisting members 17 have no shafts is that, facing each twisting member, in the upper plate 14 and in the lower plate 15, apertures 24 are cut out, allowing the threads 6 to reach the twisting member and to be carried along with the twisting member. The parts to be twisted of the thread are extending both above and below the twisting and cutting device 10 and are inserted from the side between the teeth of the twisting members 17. The cut out apertures 24 are approximately in the shape of mushrooms, the heads of which are round and the stems directed towards the edges of plate 14 or 15, located at the side where the spear 12 handles a part of the thread 6. The circular part of each cut out aperture 24 has a diameter that is approximately equal to the diameter of the circle on which the lowest points of the valleys between the teeth of the twisting member would fall should those valleys not have been made deeper. All deepened valleys 18 of the twisting member 17 face a cut out aperture 24 in the upper plate 14 and a cut out aperture 24 in the lower plate 15.

How the two parts to be twisted together of the thread 6 are lead through the cut out apertures 24 to a twisting member 17 appears clearly from FIG. 3, wherein are shown the wheels 7 and 8, and thread 6. Before the bale is being pressed, a part of the thread 6, shown in FIG. 3 with reference number 6' runs, as herein above described in connection with FIG. 1, across trunk 1, from between the wheels 7 and 8 to around wheel 9. When the bale is being pressed, this part 6' is also pushed away, whereby this part comes sideways through the apertures 24 against the twisting member 17, and enters between two teeth of this member the deepened valley 18. The position of the part 6' when the press operation is completed is shown in FIG. 3 by a dashed line. The twisting member 17 is now being turned 180°, whereby the part 6' comes in the position shown with a full line in FIG. 3. The spear that cooperates with the said thread 6 is lifted, whereby it brings a part of this thread, referred to as 6'' in FIG. 3, in front of the herein before mentioned twisting member 17. The spear 12 itself then passes through parts of the cut out aperture 24 which are facing the twisting member 17. As the part 6'' is still running around wheel 9, which, in the press direction, is located at a distance of the twisting and cutting device, the part 6'' runs obliquely, so that, when the spear 12 reaches its highest position, this part also penetrates between two teeth of the twisting member 17 and in the deepened valley 18. When the twisting member 17 rotates, the parts 6' and 6'', which are maintained in a fixed position above and below the twisting member, will be respectively twisted together just above and just below the twisting member 17. What has been described herein above for one thread 6 takes place for the four threads 6, parts 6' and 6'' of which are thus simultaneously twisted.

The planet gears 19 are part of the drive mechanism for the four twisting members 17. In fact, only one of those planet gears 19 is being driven, that is to say the planet wheel 19 which cooperates in FIG. 2 with the twisting member 17 that is positioned the most to the right and in front of a cut out aperture 24 on the longitudinal edge of the plates 14 and 15. This planet wheel 19 is in gear with a gear-wheel 25 which is rotatably mounted between the plates 14 and 15. The rotation of the last mentioned twisting member 17, is transmitted to the adjacent twisting member through the action of a planet wheel 19 that is as well a part of the trio that surrounds the said twisting member 17 as it is a part of the trio that surrounds the adjacent twisting member, and so farther unto the twisting member that is located the farthest away from the first mentioned twisting member 17. The gear-wheel 25 itself is driven, via a transmission housed in a box 26 which is mounted on the upper plate 14 and via a clutch 27, by means of a motor 31. The transmission in the box 26 is of a known construction and will not be detailed here. Controlling the motor 31 is also to be done in a way that is known by the man of the art and is of course synchronized with the motion of the spears 12.

After twisting, the parts 6' and 6'' of the thread 6 must obviously be cut through between the effectively twisted parts. For this purpose, a knife is mounted adjacent to each twisting member, just underneath the upper plate 14. In fact, the twisting and cutting device has only two knives 28, one between two extreme adjacent twisting members 17 and one between the other two extreme adjacent twisting members 17, the said knives being capable of cutting through the parts 6' and 6'' which are carried along by the two said twisting members. The knives 28 are oblong and are fixed in their center to a shaft 29 rotatably mounted in the upper plate 14 and extending above this plate 14. The extending end of each shaft 29 is unmovably fixed to an end of a long knife holder 30. This knife holder is consequently mounted on the upper plate 14 so as to be rotatable together with the knife 28. The rotation of the knives takes place via a rod mechanism which cooperates with the end of the knife holders 30 which faces away from shaft 29. This mechanism is of a known construction and will not be detailed here, and for clarity's sake has not been shown in the figures. The thickness of the knives 28 is such that they can move between the upper face of the twisting members 17 and the under face of the upper plate 14. Before and during the twisting, the knives are in the position shown in FIG. 2, that is to say with their length direction perpendicular on the line joining the centres of two adjacent twisting members between which they are mounted. the dimensions of the knives 28 are such that, in this position, they do not interfere with the motion of the parts 6' and 6'' of the threads 6 being carried along with the twisting members 17. At the end of the twisting operation, one turns the knives 28 as much as 90°, via the knife holders 30, so that their length direction becomes parallel to the line joining the centres of the adjacent twisting members 17. The length of the knives 28 is such that the two ends of the knives in the new position reach past the deepened valleys 18 in the twisting members 17, thus in way of the parts 6' and 6''. In the case of a further rotation the twisting members 17 will push the parts 6' and 6'' successively against the knives 28, whereby these parts will be cut through.

The thread parts 6' and 6'' above the twisting and cutting device and the thread parts 6' and 6'' below this device are attached the one to the other. The driving mechanism of the twisting members and the means for activating the cutting mechanism are both very simple. If the twisting and cutting mechanism has to twist and cut simultaneously a multiplicity of threads, one or more twisting members are part of the drive of other twisting members so that, in fact, only one twisting member needs to be directly driven, which greatly simplifies the construction.

Due to the fact that the twisting members 17 are provided with a deepened valley 18 between each pair of teeth, one may be sure that whichever the position of the twisting member, a part 6' or 6'' of the thread 6 will be able to get into such deepened valley 18. Consequently, it is not necessary to carefully adjust the position of these members 17 at the moment they are to take along a part 6' or 6''. Nor is it necessary that the two parts 6' and 6'' penetrate into two diametrally opposed deepened valleys 18. They must not, of course, penetrate into the same or into two deepened valleys which are located too near each other.

it is not necessary that the twisting and cutting device should comprise four twisting members. In fact, it may well comprise only one twisting member.

Furthermore, one knife must not necessarily cut the threads carried along by two adjacent twisting members. It is also possible to provide each twisting member with a knife.

I claim:

1. A twisting device for two parts of thread running from different feed spools and made to be adjacent to each other at the location of the device, said device comprising:

a frame, three gear-wheels rotatably mounted in relation to the frame, a twisting member consisting of a fourth gear-wheel mounted in relation to the frame in the space enclosed by said three gear-wheels and being in direct mesh with each of said three gear-wheels, and driving means for one of said three gear-wheels, said twisting member having teeth and valleys between the teeth, at least some of these valleys being deep enough to receive simultaneously a tooth of one of said three gear-wheels and the thread, said frame being provided with a cut out aperture in front of the twisting member permitting the thread to enter into one of said deep enough valleys.

2. The twisting device of claim 1, in which the frame comprises an upper plate and a lower plate, said three gear-wheels being rotatably mounted between said upper plate and said lower plate.

3. A twisting device for two parts of a thread running from different feed spools and made to be adjacent to each other at the location of the device, said device comprising:

a frame with an upper plate and a lower plate, three gear-wheels, an upper bearing between each gear-wheel and the upper plate, a lower bearing between each gear-wheel and the lower plate, said upper bearings extending outside of the gear-wheels in such a way that they form upper shoulders, said lower bearings extending outside of the gear-wheels in such a way that they form lower shoulders, a twisting member consisting of a fourth gear-wheel mounted between said upper shoulders and said lower shoulders and being in gear with each of the three gear-wheels, and driving means for one of said three gear-wheels, said twisting member having teeth and valleys between the teeth, at least some of these valleys being deep enough to receive simultaneously a tooth of one of said three gear-wheels and the thread, said frame being provided with a cut out aperture in front of the twisting member, permitting the thread to enter into one of said deep enough valleys.

4. The twisting device of claim 3 comprising a knife mounted in relation to the frame close to the twisting member.

5. The twisting device of claim 4, comprising means bringing the knife into a first position in the way of the thread carried along by the twisting member and into a second position out of said way.

6. The twisting device of claim 4, in which the cut out aperture is at one side of the twisting member and the knife is on the other side of the twisting member.

7. The twisting device of claim 3 including:

several twisting members each consisting of a gear-wheel rotatably mounted side by side in relation to the frame and three gear wheels in direct mesh with each twisting member.

8. A twisting device for two parts of two threads running from different feed spools, the two parts of each thread being made to be adjacent to each other at the location of the device, said device comprising:

a frame, two twisting members consisting of a gear-wheel rotatably mounted side by side in relation to the frame, driving means for each of said twisting members comprising a gear-wheel in gear with the twisting member and rotatably mounted in relation to the frame, a knife mounted in relation to the frame between said twisting members, and means bringing the knife into a first position in the ways of the threads carried along by the twisting members and into a second position out of said ways, said twisting members having teeth and valleys between the teeth, at least some of the valleys of each twisting member being deep enough to receive simultaneously a thread and a tooth of a gear-wheel of the driving means which is in gear with said twisting member, said frame being provided with a cut out aperture in front of each twisting member permitting the thread to enter into one of said deep enough valleys.

* * * * *